United States Patent [19]

Rathe

[11] Patent Number: 4,592,474

[45] Date of Patent: Jun. 3, 1986

[54] COUPLING AND LATCHING MECHANISM FOR EXTENSIBLE BOOM

[75] Inventor: Robert A. Rathe, Cedar Rapids, Iowa

[73] Assignee: FMC Corporation, Chicago, Ill.

[21] Appl. No.: 652,234

[22] Filed: Oct. 30, 1984

Related U.S. Application Data

[62] Division of Ser. No. 293,729, Aug. 17, 1981, Pat. No. 4,492,311.

[51] Int. Cl.[4] ..... B66C 23/04

[52] U.S. Cl. ..... 212/267; 52/121

[58] Field of Search ..... 212/223, 229, 230–231, 212/264, 266–268, 184, 199, 202–204; 52/114–118; 403/315–316, 330

[56] References Cited

U.S. PATENT DOCUMENTS

| | | | |
|---|---|---|---|
| Re. 27,763 | 9/1973 | Fauchere | 212/55 |
| 2,612,242 | 9/1952 | Munsinger | 189/15 |
| 2,695,082 | 11/1954 | Mills | 189/11 |
| 2,739,361 | 3/1956 | Elsner | 24/211 |
| 2,794,633 | 6/1957 | Delany | 268/30 |
| 2,920,725 | 1/1960 | Emmons | 189/11 |
| 2,942,700 | 6/1960 | Parmenter et al. | 189/14 |
| 3,112,035 | 11/1963 | Knight | 212/55 |
| 3,187,905 | 6/1965 | Moskopf et al. | 212/55 |
| 3,243,052 | 3/1966 | Grove | 212/55 |
| 3,250,182 | 5/1966 | Nansel | 91/167 |
| 3,312,487 | 4/1967 | McIntyre | 287/58 |
| 3,346,281 | 10/1967 | Thompson | 287/58 |
| 3,368,696 | 2/1968 | Johnston et al. | 212/59 |
| 3,386,594 | 6/1968 | Grove | 212/55 |
| 3,398,492 | 8/1968 | Nansel | 52/115 |
| 3,464,169 | 9/1969 | Potain | 52/115 |
| 3,727,359 | 4/1973 | Vonck | 52/121 |
| 3,738,075 | 6/1973 | Nansel | 52/115 |
| 3,749,254 | 7/1973 | Grider | 212/55 |
| 3,770,138 | 11/1973 | Chalupsky et al. | 212/55 |
| 3,795,321 | 3/1974 | Johnston | 212/55 |
| 3,842,985 | 10/1974 | Svede | 212/55 |
| 3,921,819 | 11/1975 | Spain | 212/144 |
| 4,133,411 | 1/1979 | Curb | 212/144 |
| 4,213,590 | 7/1980 | VanDyke | 410/64 |
| 4,217,987 | 8/1980 | Gattu et al. | 212/144 |
| 4,303,165 | 12/1981 | Cassens et al. | 212/184 |
| 4,327,533 | 5/1982 | Sterner | 212/268 |
| 4,350,255 | 9/1982 | Blase et al. | 212/268 |
| 4,352,434 | 10/1982 | Poock | 212/186 |

*Primary Examiner*—Trygve M. Blix
*Assistant Examiner*—Stephen P. Avila
*Attorney, Agent, or Firm*—A. J. Moore; R. C. Kamp; R. B. Megley

[57] ABSTRACT

A coupling and latching mechanism for a multi-section extensible boom that includes a manual section and is operable from a remote location such as the cab of a crane. The mechanism includes pairs of spaced jaw type couplings secured to adjacent boom sections and adapted to be selectively coupled to the piston rod or the like of an extensible ram for operating the boom either with the manual section extended or retracted. Remotely controlled latch locking blocks are provided to latch the manual section in a plurality of extended positons, or in a retracted position.

3 Claims, 12 Drawing Figures

160
10
9
80
82
84
86
58
31
B
18
23
178
164
53
54
24
26
28
30
122
116
114
122a
16a
14a
144
146
148
150
152
132
130
138
140
136
162
166
Z
X
170
172
174
176
98
100
102
104

COUPLING AND LATCHING MECHANISM FOR EXTENSIBLE BOOM

This application is a division of application Ser. No. 293,729, filed Aug. 17, 1981, which issued on Jan. 8, 1985 as U.S. Pat. No. 4,492,311.

CROSS REFERENCE TO RELATED APPLICATIONS

The present application is related to several United States applications all of which are assigned to the assignee of the present invention, and were filed on the indicated date or on even date herewith. The applications are as follows: Poock Appln. Ser. No. 145,529 which was filed May 1, 1980 entitled Pendant Supported Hydraulic Extensible Boom, now U.S. Pat. No. 4,352,098 which issued on Oct. 5, 1982; Cozad application Ser. No. 293,727 filed on Aug. 17, 1981 and entitled Low Droop Multi-Part Pendant Supported Boom; Rathe et al Appln. Ser. No. 293,728 filed on Aug. 17, 1981 and entitled Extensible Boom With Manual Stored in Base, now U.S. Pat. No. 4,489,838 which issued on Dec. 25, 1984.

BACKGROUND OF THE INVENTION

FIELD OF THE INVENTION

The present invention relates to a coupling and latching mechanism for multi-section telescopic booms that is operated from a remote location such as the cab of a crane, and more particularly relates to such a mechanism used with a four-section pendant supported boom having a manual section stored in its base with the extensible boom section being extended and retracted by a single ram aided by extend and retract cables for actuating the tip section.

2. Description of the Prior Art

As used herein and as understood in the art, a manual section is a boom section that is normally retracted within its supporting boom section but may be coupled to a boom extend and retract power means and be extended when needed to increase the reach of the boom.

Multi-section, pendant supported, telescopic booms for cranes or the like which are operated by single hydraulic rams or a plurality of rams are well known in the art. However, applicant is unaware of art that discloses a coupling and latching mechanism that is operated from a position remote from the boom for selectively coupling the manual or base sections to a ram and locking the manual in a selected one of a plurality of positions after the ram has moved the manual section to the selected position.

SUMMARY OF THE INVENTION

In accordance with the preferred embodiment of the present invention a multi-section telescopic boom is arranged so that it second heaviest boom section is a manual section which is stored in the base section of the boom. In the preferred embodiment of the four-section boom, a single hydraulic ram, aided by a tip section extend-retract cable, is provided to extend and retract the mid and tip sections proportionally relative to the manual section. When less than full extension of the boom is required, the manual section is stored and locked to the base section with the piston rod coupled to both the manual section and the base section for extending and retracting the outer two sections relative to the manual and base sections.

When full extension of the boom is required the coupling and latching mechanism is actuated to initially uncouple the piston rod from the manual section, to lock the manual and mid-sections together in retracted position, and to unlock the manual from the base section. The ram is then actuated to extend the manual, mid, and tip sections relative to the base. The coupling and latching mechanism is then actuated to lock the manual in extended position to the base, to release the manual section from the mid section, and to uncouple the piston from the base section. The ram is then actuated to retract the piston rod and couple the piston rod to the extended manual section. Thereafter, operation of the ram will proportionally extend or retract the mid and tip sections relative to the extended manual section.

DESCRIPTION OF THE PREFERRED EMBODIMENT

Figure 1:
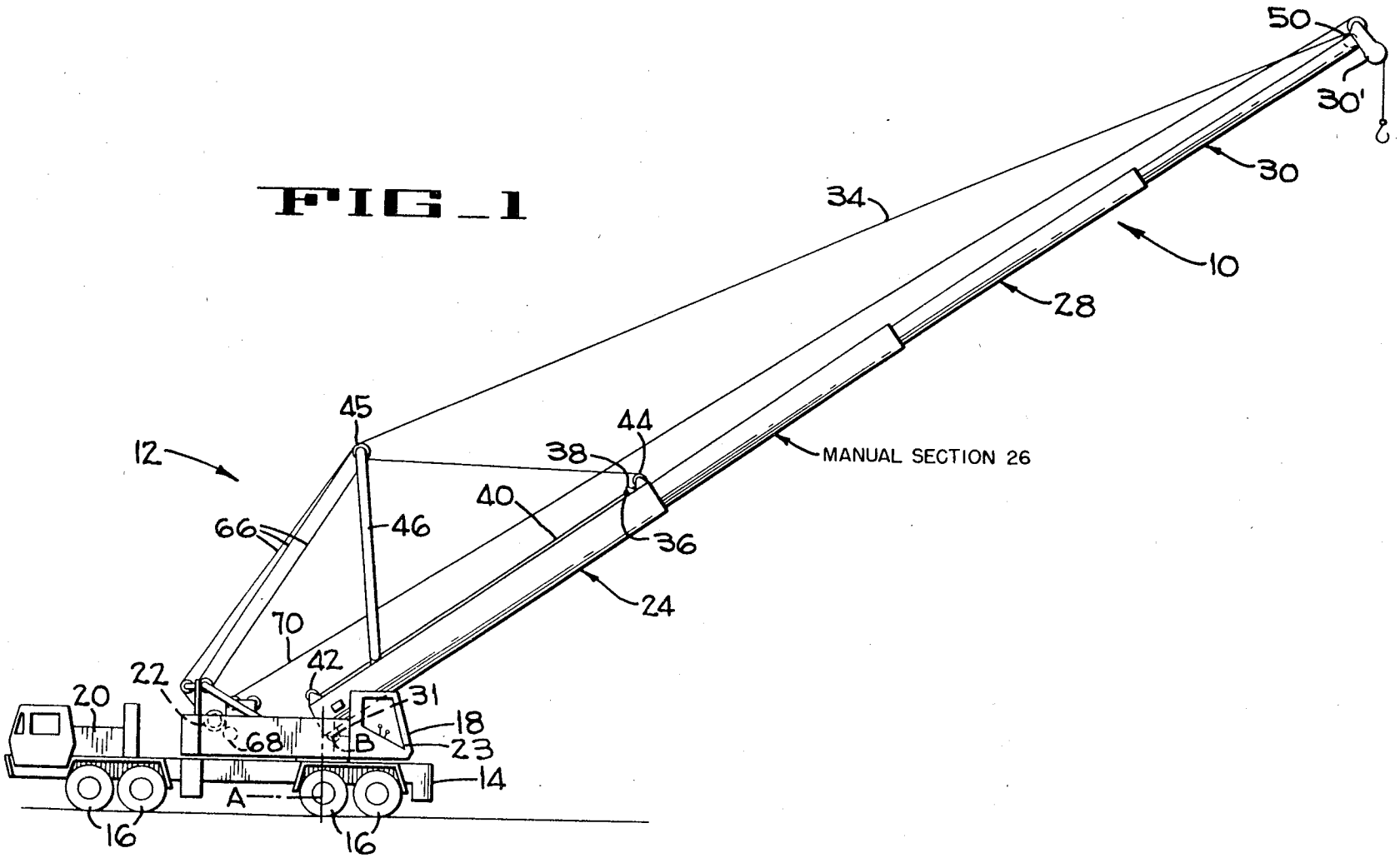
FIG. 1 is a side elevation of a crane in which the coupling and latching mechanism of the present invention is incorporated, the boom being supported by pendant lines and illustrated in a fully extended position.

The coupling and latching mechanism 9 (FIGS. 2–4) of the present invention is illustrated as a component of an extensible boom 10 of a mobile crane 12 (FIG. 1). The crane 12 includes a chassis 14 supported on wheels 16 with an upper works 18 mounted for rotation on the chassis about a vertical axis A. The crane includes an engine 20 which provides power for driving at least some of the wheels 16, for rotating the upper works 18, and for dividing hydraulic pumps and motors which provide power for several winches, including a boom supporting winch 22 all under the control of an operator when in the cab 23 of the crane 12.

The boom 10 is illustrated as a four section pendant supported boom which includes base section 24, a manual section 26, a mid section 28, and a tip section 30 all telescopically received within each other and slidably supported on boom shoes (not shown) of standard design. The base section 24 is the largest boom section in tubular cross section and is the heaviest section, the manual section is the next heaviest section, and the tip section 30 is the smallest in tubular cross-section and the lightest section of the boom 10 when the weight of the head machinery 30' is excluded. Each of the four sections of the boom are substantially equal in length.

The base section 24 (FIG. 1) is mounted on the upper works 18 by a boom foot 31 for pivotal movement about a horizontal axis B between a generally horizontal transport position and a plurality of elevated operative positions, with one elevated position being shown in FIG. 1.

Figure 8:
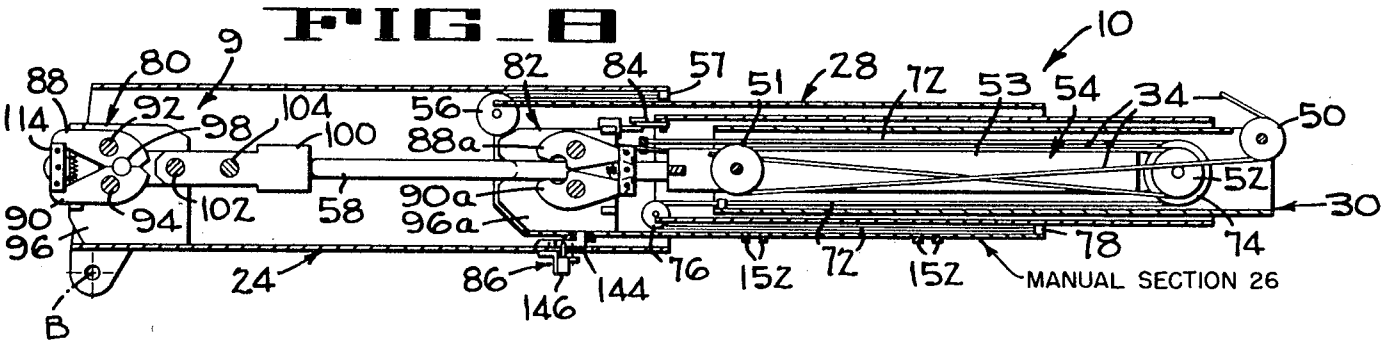
FIG. 8 is a diagrammatic operational view similar to FIG. 6 but illustrating the manual section fully extended and locked in extended position by the base-manual latch, and with the piston rod coupled to the base section.
Figure 9:
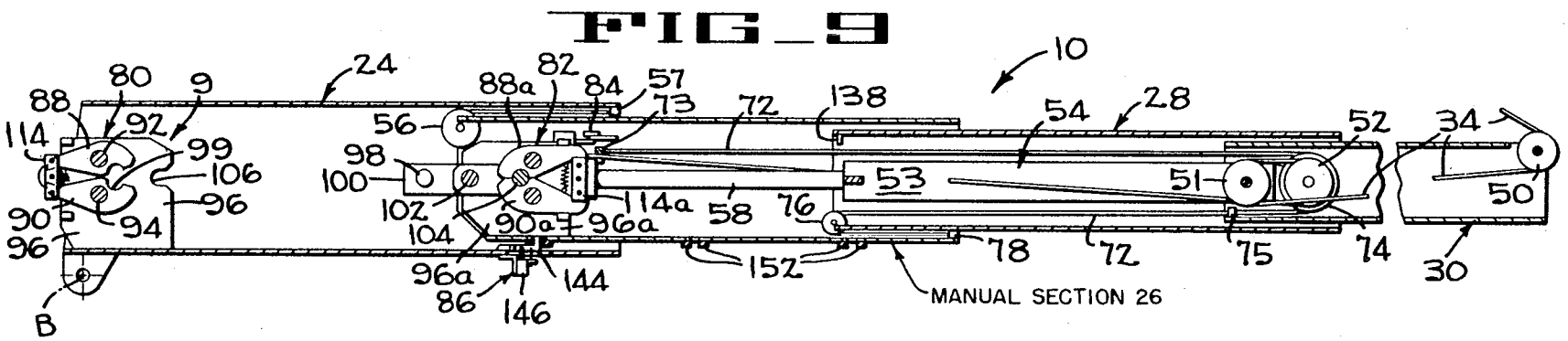
FIG. 9 is a diagrammatic operational view similar to FIG. 8 but with the piston rod released from the base section and coupled to the manual section and showing the mid and tip sections extended.
Figure 10:
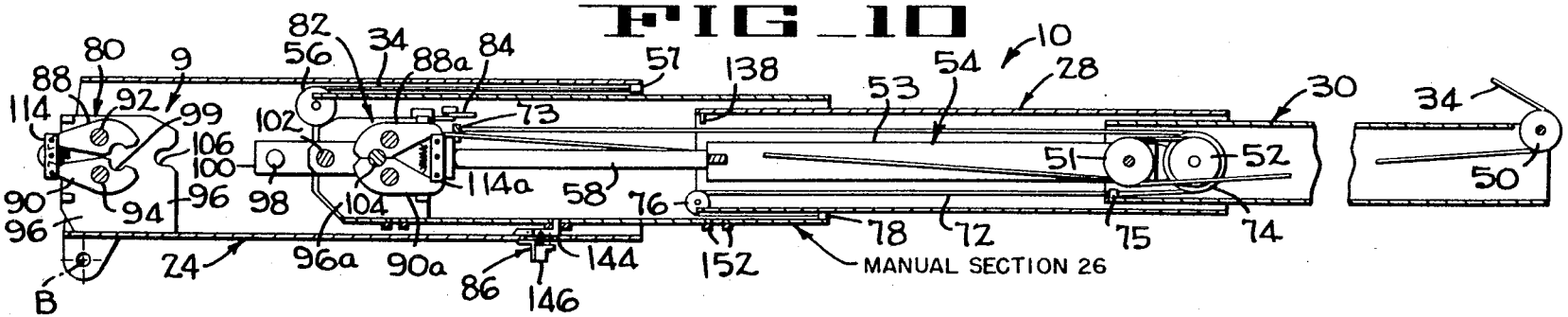
FIG. 10 is a diagrammatic operational view similar to FIG. 9 but with the base-manual latch locking manual section in an intermediate position.

The preferred structure for raising and lowering the boom is somewhat similar to that described and claimed in the cross-referenced Cozad application. This structure includes at least one, but preferably two side-by-side fixed pendant lines 34 to the outer end of the tip section 30 to provide better boom support. One end of each pendant line 34 has an abutment 36 thereon which engages an abutment 38 on the base section 24 to anchor the pendant 34 when the boom is being supported by the pendant. When in transport position, a pendant retract line 40 is wound upon a small winch 42 to maintain tension on the pendant 34 by moving the aburment 36 away from the abutment 38. The pendant line 34 is trained around a sheave 44 journaled on the forward end of the base section 24, a sheave 45 journaled on the upper end of a live mast 46, and a sheave 50 journaled on the outer end of the tip section 30 to provide said above mentioned support. The pendant line 34 then enters the boom 10 through the tubular tip section 30 as shown in double lines in FIGS. 3 and 4. The pendant 34 is then trained around a sheave 51 journaled on the inner end of the tip section 30, is looped around a sheave 52 journaled on the outer end of a cylinder 53 of a hydraulic ram 54, and is trained around a sheave 56 journaled on the inner end of the manual section 26. The other end of the pendant line 34 is anchored to the outer end of the base section 24 at 57 (FIG. 4). The inner end of the cylinder 53 is anchored to the inner end of the mid section 28 while the piston rod 58 of the ram 54 is normally coupled to both the base section 24 and the manual section 26 (FIGS. 3–5) but may be coupled only to the base section 24 (FIGS. 6 and 8) when it is desired to extend or retract the manual section 26 relative to the base section. When it is desired to operate the boom 10 with the manual locked in the fully extended or partially extended position, the piston rod 58 is coupled only to the manual section 26 as illustrated in FIGS. 9 and 10, respectively.

As shown in FIG. 1, the boom 10, is raised or lowered by the winch 22 which is connected to the upper end of the live mast 46 by reeving 66. Another winch 68 is provided for raising and lowering a load (not shown) that is connected thereto by a load line 70 in a conventional manner.

Figure 3:
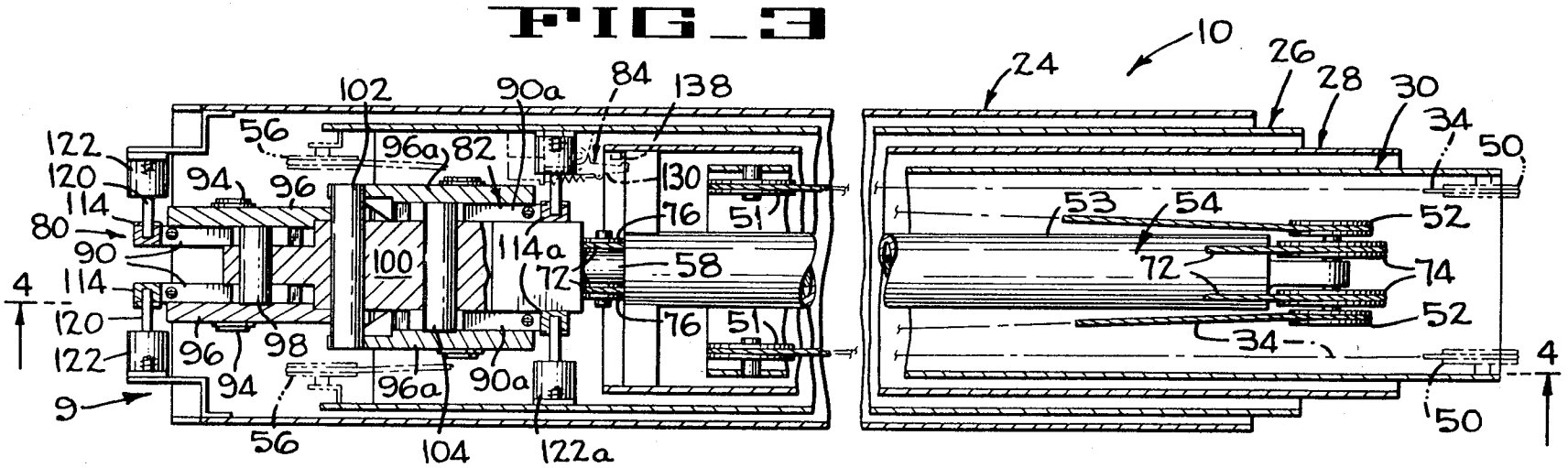
FIG. 3 is a horizontal central section taken along lines 3—3 of FIG. 4 through the boom with all sections of the boom being fully retracted, the length of each boom section being greatly foreshortened and the boom shoes or bearings being omitted for clarity.
Figure 4:
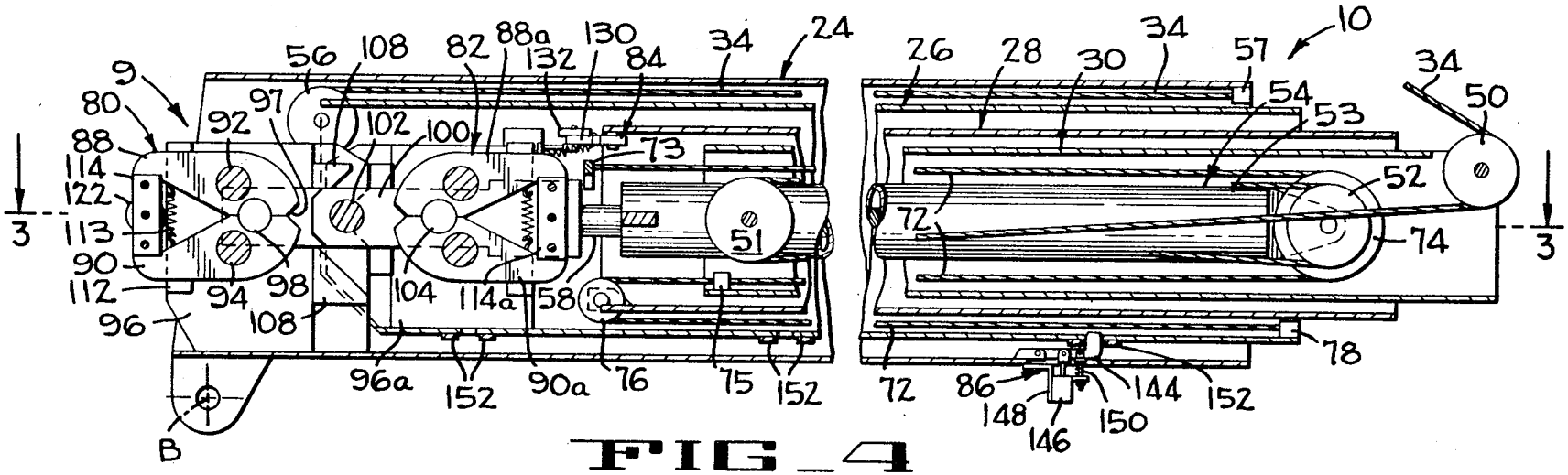
FIG. 4 is a vertical section taken substantially along lines 4—4 of FIG. 3.
Figure 5:
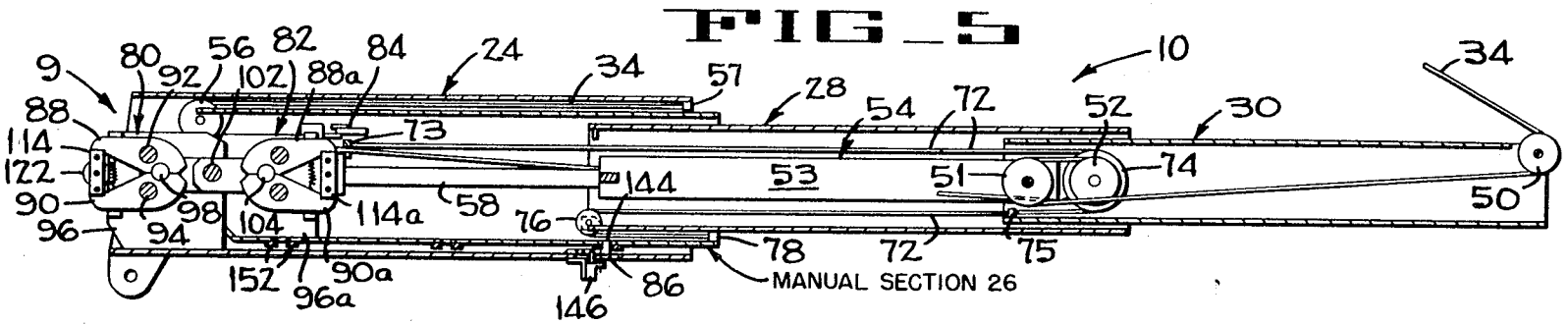
FIG. 5 is a diagrammatic operational view in vertical section similar to FIG. 4 but with the manual section retracted and with the mid and base sections fully extended relative to the manual section.

As shown in FIGS. 3–5, the tip section 30 is extended and retracted in response to extension and retraction of the ram 54 when the piston rod 58 is connected to the manual section 26. For this purpose at least one extend-retract cable 72 is provided.

One end of the extend-retract cable 72 is attached to the inner end of the manual section 26 by a connector 73, such as a bracket. The cable then extends around a sheave 74 journaled on the outer end of the ram 54, an intermediate portion of the cable 72 is attached to the inner end of the tip section 30 by another connector 75, the cable is then trained around a sheave 76 journaled on the inner end of a mid section 28, and the other end of the cable 72 is attached to the outer end of the manual section 26 by a connector 78.

The coupling and latching mechanism 9 (FIGS. 2–5) in general comprises a base-rod coupling 80, manual rod coupling 82, a manual mid-latch 84 and a base manual latch 86. The base-rod coupling 80 and the manual rod coupling 82 each includes two pair of spaced symmetrical right and left hand jaw units. Since the jaw units of each couplings are substantially identical, only one pair of jaw units for each coupling will be described in detail and the same numerals will be used to identify the other unit of that coupling.

The base-rod coupling 80 includes upper jaw 88 and lower jaw 90 secured to stub shafts 92,94 pivoted to an upstanding guide plate 96 rigidly secured to the rear end of the base section 24 of the boom 10. The forward ends of the jaws 88,90 are provided with jaw opening surfaces which define a V-shaped notch 97 that receives and opens the jaws 88,90 when engaged by a transverse coupling pin 98 in response to extension of the piston rod 58. Concentric semi-cylindrical locking grooves 99 (FIGS. 2 and 9) in the jaws 88,90 automatically close over the pin when the piston rod moves the coupling pin 98 into locking position.

Figure 2:
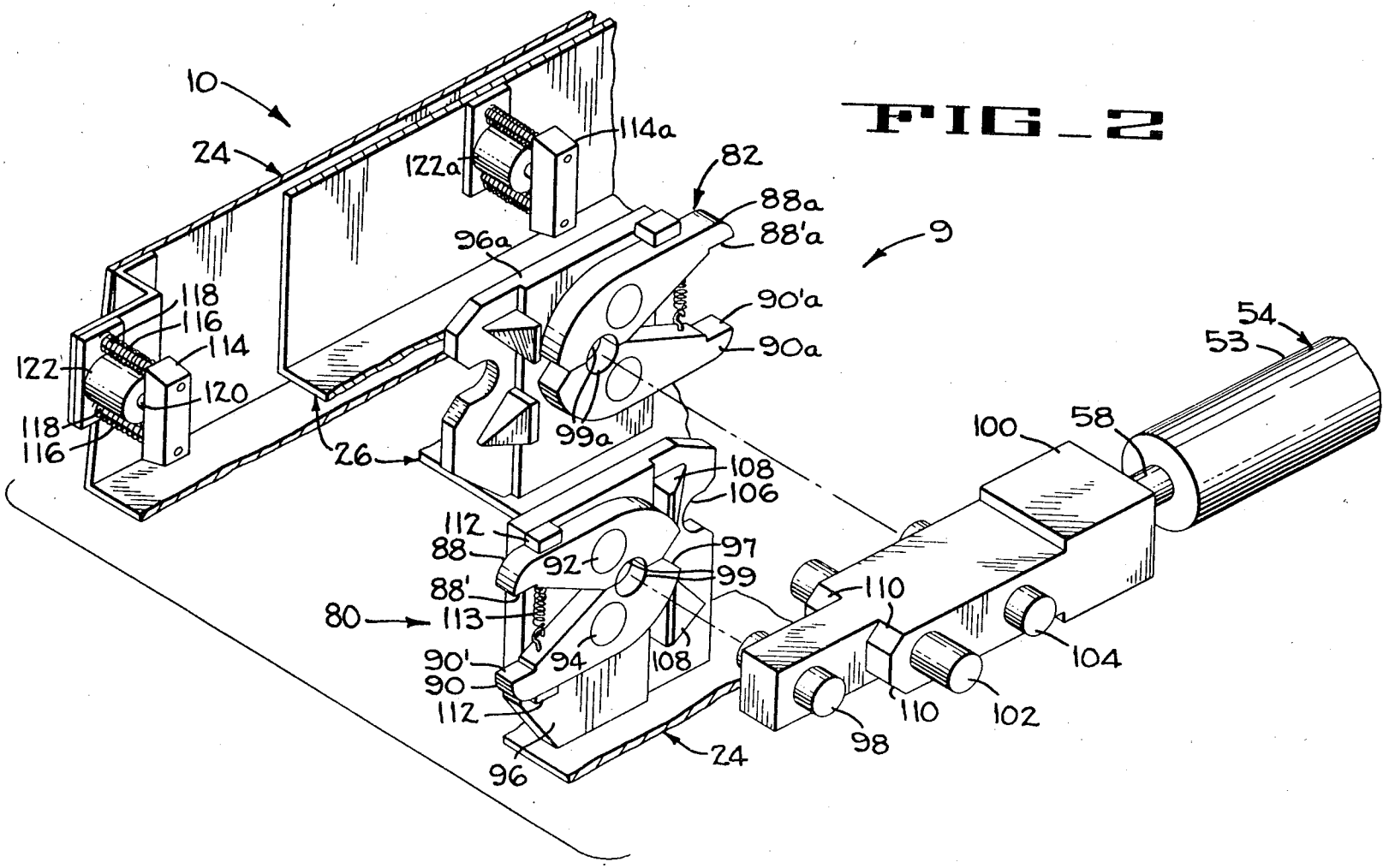
FIG. 2 is an enlarged exploded perspective of a portion of the coupling and latching mechanism with the coupling elements being illustrated in the position they assume when the base section and manual section are in the fully retracted position.

As best shown in FIG. 2, the coupling pin 98 is secured to a narrow portion of a rod guiding and latching block 100 that is rigidly secured to the free end of the piston rod 58 and may be considered as an extension of the rod 58. The block 100 also receives a longer transversely extending guide pin 102 and a second coupling pin 104 associated with the manual-rod coupling 82. Prior to the coupling pin 98 moving into the locking groove 99, the guide plates 96 thereby aligning the pin 98 with the groove 99 in the event the piston rod 58 has pivoted about its axis. Triangular abutments 108 (FIG. 2) secured to the guide plate 96 assist in maintaining the pins 98,102 and 104 in desired horizontal position by engaging chamfered surfaces 110 on the block 100.

As best shown in FIGS. 2, 9 and 10, stop lugs 112 are secured to the guide plates 96 in position to limit the free pivotal movement of the jaws 88,90. The jaws are preferably urged toward their open positions by tension springs 113 or the like although they may be opened by the force of gravity.

In order to lock the jaws 88,90 on the coupling pin 98, a tapered locking block 114 is urged by spring 116 between rear end portions 88' and 90' of the jaws 88,90.

The locking blocks 114 and springs 116 are slidably received on guide pins 118 that are secured to the adjacent side wall of the base section 24. The block 114 is also rigidly secured to the piston rod 120 of an air cylinder 122 that is secured to the base section 24. Accordingly, when the jaws 88,90 are closed about the pin 98 and the locking block 114 is resiliently urged between the end portions 88', 90' (FIG. 2), the piston rod 58 is locked to the base section 24. The rod 58 is unlocked from the base-rod coupling 80 and base section 24 by activation of the air cylinder 122 thus pulling the locking blocks 114 from between the end portions of the jaws as shown in FIGS. 2, 9 and 10.

The manual-rod coupling 82 (FIGS. 2–4) is substantially the same as the base-rod coupling 80. Accordingly, only the differences will be described in detail, and equivalent parts will be assigned the same numerals followed by the letter "a".

The jaws **88*a* and 90*a* of the manual-rod coupling 82 are pivoted to the upstanding guide plates 96*a*. The guide plates 96*a* are secured to the manual section 26 and are spaced apart a greater distance than the plates 96, as shown in FIG. 3, in order to locate the two pairs of jaws in positions to receive coupling pin 104 which is substantially longer than the coupling pin 98. Also, the jaws 88*a*,90*a*, and their supporting plates 96*a* are reversed as compared to jaws 88,90 and plates 96 of the base-rod coupling 80. Thus, the pin 104 is placed in the locking groove 99*a* either by moving the piston rod 58 to the right from the FIG. 8 position to the FIG. 9 or 10 positions, or alternately; moving the manual section 26 toward the left from the FIG. 8 position through the FIG. 6 position and to the FIG. 4** position.

The jaws **88*a* and 90*a* are locked to the coupling pin 104 by resiliently urging the associated locking block 114*a* between the end portions 88*a*,90*a* as shown in FIGS. 3 and 4. Actuation of air cylinder 122*a* will pull the locking block 114*e* away from the jaws and thereby release the manual-rod coupling 82**.

Figure 6:
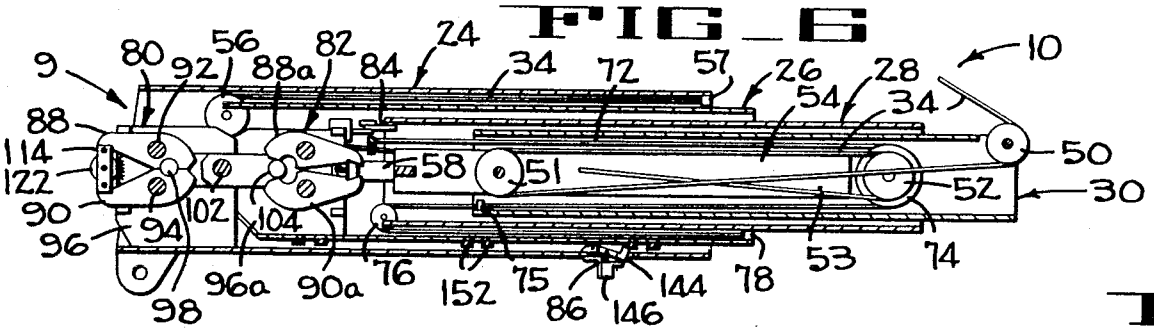
FIG. 6 is an operational view similar to FIG. 5 but with the manual section uncoupled from the piston rod and slightly extended, and with the manual latched to the mid section.
Figure 7:
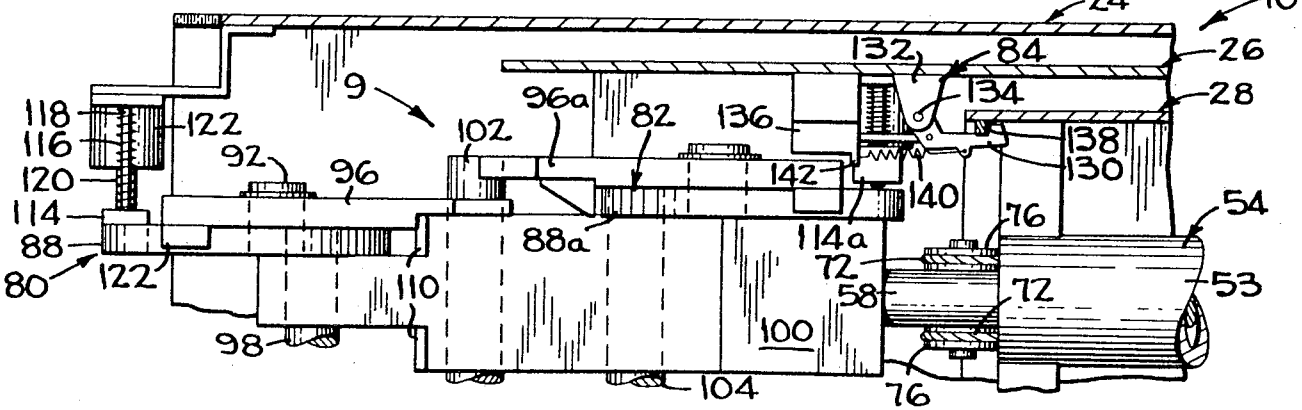
FIG. 7 is an enlarged horizontal section illustrating the manual-mid latch in latch position and the manual-piston coupling in its released position.

In order to extend the manual section 28 from its retracted position such as illustrated in FIG. 6, it is necessary to uncouple the manual-rod coupling 82 and latch the manual section 26 to the mid section 28 by means of a manual-mid latch 84 (FIGS. 4 and 7).

The manual-mid latch 84 comprises a hook 130 that is pivotally connected to the manual section 26 by ear 132 and a pivot pin 134 (FIG. 7). The piston rod of an air cylinder 136 is pivotally connected to the hook 130 and when activated moves the hook 130 into the latched position of FIG. 7 into engagement with an abutment 138 secured to the mid-section 28. A spring 140 is connected between the hook 130 and a bracket 142 which supports the air cylinder 136 and is connected to the manual section 26. The spring 140 normally holds the manual-mid latch 84 in an uncoupled position as shown in phantom lines in FIG. 3.

The base-manual latch 86 (FIG. 4) is provided to lock the manual section 26 in selected ones of a plurality of positions relative to the base section 24. The latch 86 comprises a hook 144 pivoted to the base section 24. An air cylinder 146 is secured to the base section 24 by a bracket 148 and has its piston pivotally connected to the hook 144 for unlatching the hook from the manual section 26 when energized as shown in FIG. 6. A compression spring 150 is connected between the hook 144 and the bracket 148 and normally urges the hook 144 into latched position between pairs of abutment 152 secured to the manual section. As shown in the drawings, pairs of abutments 152 are positioned on the manual section to selectively hold the manual fully retracted (FIG. 5), fully extended (FIGS. 8 and 9), and at an intermediate position (FIG. 10).

Figures 11, 12:
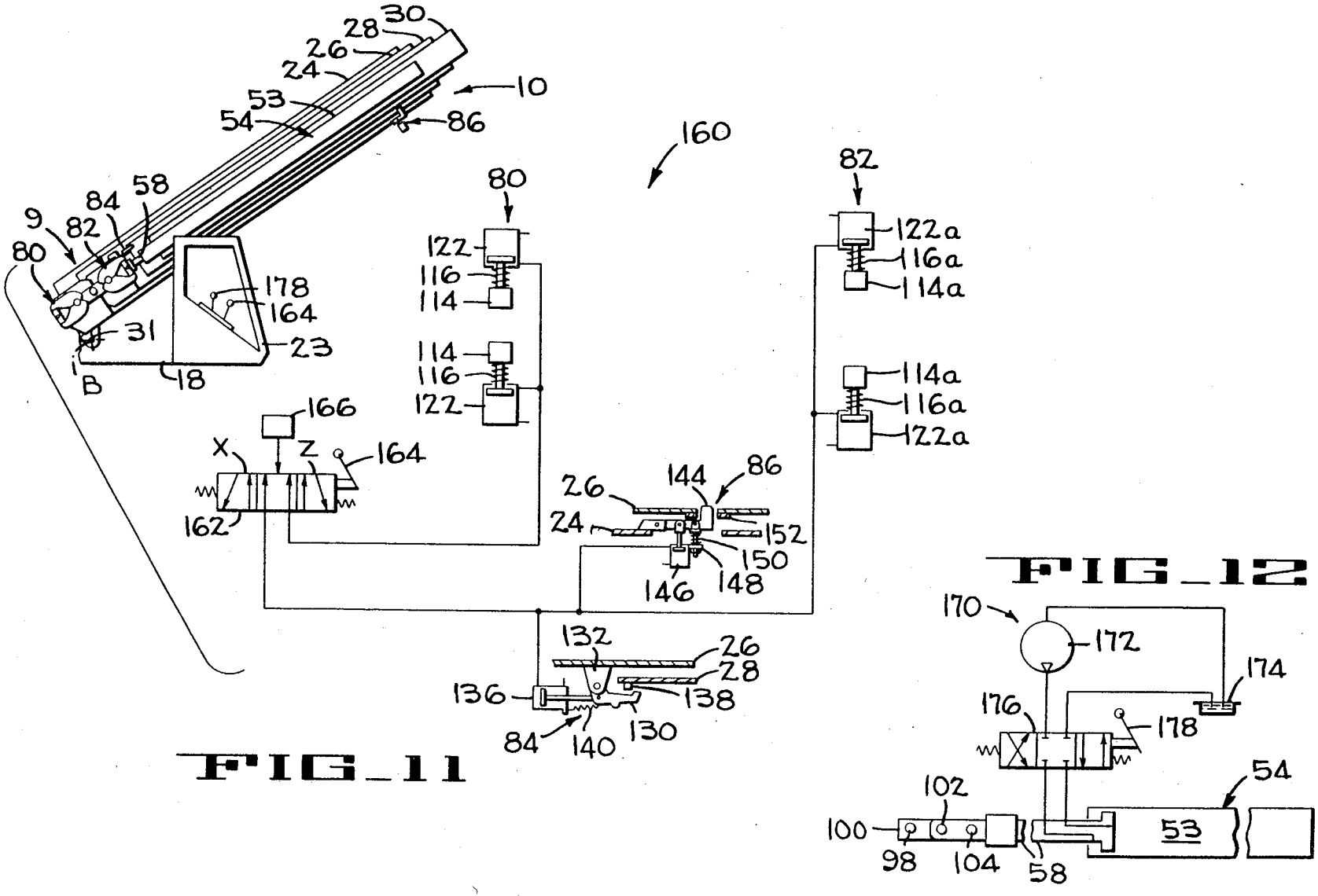
FIG. 11 is a diagrammatic exploded view illustrating a pneumatic circuit for controlling the functions of the coupling and latching mechanism from the operator's cab of a crane.
FIG. 12 is a simplified hydraulic circuit for operating the single boom extend-retract ram from the cab.

A simplified pneumatic circuit 160 is illustrated in FIG. 11 along with a diagrammatic illustration of the boom 10 and the operator's cab 23. The pneumatic circuit includes a manually operated valve 162 which is controlled from the cab 23 by an operator who selectively actuates the valve core by means of a lever 164. The core is spring centered to a neutral position which prevents flow of air from a high pressure air source 166, and is movable between positions X and Z by the operator.

When the valve 162 is in its illustrated neutral position, the pneumatically controlled components are positioned as follows:

Base-rod coupling 80—closed
Manual-rod coupling 82—closed
Base-manual latch 86—latched
Manual-mid latch 84—unlatched.

When the valve 162 is in position "X", the pneumatically controlled components are positioned as follows:

Base-rod coupling 80—closed
Manual-rod coupling 82—open
Base-manual latch 86—unlatched
Manual-mid latch 84—latched.

When the valve 162 is in position "Z", the pneumatically controlled components are positioned as follows:

Base-rod coupling 80—open
Manual-rod coupling 82—closed
Base-manual latch 86—latched
Manual-mid latch 84—unlatched.

It will be understood that the above described term "closed" as used to describe the position of the base-rod and manual-rod couplings also includes "closable positions" of these couplings. For example, coupling 80 as illustrated in FIG. 6 is in its closable position and will be fully closed and locked in closed position when the piston rod 58 is moved to the left (FIG. 6) sufficiently to position the pin 104 in coupling position at which time the associated locking block **174*a* (FIG. 2) will be spring urged into position to lock the associated jaws 88*a* and 90*a*** closed.

It will be understood that the components of the pneumatic circuit 160 include the valve 162, the base-rod air cylinders 122 and springs 116, the manual rod-air cylinders **122*a* and springs 116*a*, the base-manual latch cylinder 146 and its return spring 150, and the manual-mid latch cylinder 136 and its return spring 140** all of which cooperate to define a first control means.

FIG. 12 diagrammatically illustrates a simplified hydraulic circuit 170 for extending and retracting the ram 54. The hydraulic circuit includes the usual driven hydraulic pump 172, a reservoir 174 and a spring centered valve 176 which is operated from the cab 23 by a handle 178.

The circuits 160 and 170 and the operation of the coupling and latch mechanism 9 of the present invention will be described in conjunction with the boom positions illustrated in FIGS. 4–10.

The boom 10 is lowered to a generally horizontal position prior to extending or retracting the manual section 26 relative to the base section 24. With the valve 162 (FIG. 11) and the valve 176 (FIG. 12) in their illustrated neutral positions, and with the boom sections fully retracted as shown in FIG. 4; the base-rod coupling 80 will be held closed and thus locked to the pin 98, the manual-rod coupling 82 will be held closed and locked to the pin 104, the manual-mid latch 84 will be resiliently held unlatched, and the base-latch 86 will be spring urged into position to latch the manual 26 to the base 24 in its fully retracted position.

When the load to be carried is within reach of the boom 10 when the manual 26 is retracted and stored in the base section, the boom is in its preferred operative condition. The operator then leaves the valve 162 in its neutral position and merely controls the hydraulic ram 54 by means of the valve 176 to proportionally extend and retract the mid section 28 and tip section 30 relative to the manual and base sections as required. In this way, the mid section 26 and the tip section 30 are moved between the fully retracted position of FIG. 4 and the extended position of FIG. 5. The operator also has controls (not shown) in the cab 23 for pivotally raising and lowering the boom and for raising and lowering the load line 70 all as is conventional in the art.

If it is determined that the manual section 26 must be fully (FIGS. 8 and 9) or partially (FIG. 10) extended in order to reach and carry the load, the operator retracts the ram 54 by moving the hydraulic valve 176 (FIG. 12) to its parallel passage position. The operator then shifts the pneumatic valve 162 (FIG. 11) to the "X" position at which time the base-rod coupling 80 is closed, the manual-rod coupling 82 is opened, the base-manual latch 86 is unlatched, and the manual-mid latch 84 is latched as previously described and as shown in FIG. 6. With the pneumatic valve 162 maintained in the "X" position, the operator then places the hydraulic valve 176 (FIG. 12) in the parallel passage position thereby extending the ram 54 and manual section 26 until the manual section reaches its fully extended position as shown in FIG. 9, or the intermediate position shown in FIG. 10.

When the manual section 26 has been moved to the desired fully or partially extended position, the pneumatic valve 162 is then momentarily placed in the "Z" position thereby opening the base-rod coupling 80, closing he manual-rod coupling 82, latching the base-manual latch 86 and unlatching the manual-mid latch 84 all as previously described and illustrated in FIGS. 9 and 10. With the base-rod coupling open, the hydraulic valve 176 (FIG. 12) is moved to the parallel passage position thereby moving the piston rod 58 out of engagement with the base-rod coupling 86. While the piston rod 58 is moving to the right (FIGS. 9 and 10), the pneumatic valve 162 is moved to the "X" position thereby opening the manual-rod coupling 82 and allowing the pin 104 on the piston rod 58 to enter the manual-rod coupling 82. The hydraulic valve 176 and the pneumatic valve 162 are then placed in their neutral positions thus latching the manual-rod coupling 82 to the piston rod 58 as shown in FIGS. 9 and 10.

With the manual section connected to the piston rod as above described, and with the pneumatic valve 162 in its neutral position, the spring 140 releases the manual-mid latch 84, and the spring 116 of the base-rod coupling 80 resiliently moves the locking blocks 114 against the side of at least one of the associated jaws 88,90 as shown in FIG. 9.

The operator then actuates hydraulic valve 176 to extend and retract the mid-section 28 and tip-section 30 as required. At this time the manual is locked in the fully extended position (FIG. 9) or in a partially extended position as shown in FIG. 10.

When retracting the boom sections from their extended positions illustrated in FIGS. 9 or 10 through the FIG. 6 position to its FIG. 4 position, the operator first moves the hydraulic valve 176 to its parallel passage position thereby retracting the mid and tip sections. The operator then moves pneumatic valve 162 to the "X" position thereby activating the pneumatic cylinder 122*a* (FIG. 11) thus withdrawing the locking blocks 114*a* from between the jaws 88*a*,90*a* thereby releasing the manual-rod coupling 82. The operator then shifts the hydraulic valve 176 to the cross passage position thereby extending the ram 54 causing the pin 104 to open the jaws 88,90 and then causes the pin 98 to enter and be clamped between the jaws 88 and 90 of manual-rod copling 80. Closing of the jaws 88,90 allows tapered locking blocks 114 to be spring urged between the jaws 88.90 thereby coupling the piston rod 58 to the manual section 26. Holding the pneumatic valve 162 to the "X" position unlatches the base-manual latch 86, latches the manual-mid latch 84, and retracts the wedge blocks 114*a* from the already uncoupled manual-rod coupling 84. While maintaining the pneumatic valve 162 in position "X", the operator moves the hyraulic valve 176 to the parallel passage position thus returning the boom 10 to its fully retracted position of FIG. 4.

Although an air circuit 160 has been illustrated and described as the means for controlling the couplings 80,82 and the latches 84,86, it will be understood that other equivalent controls may be substituted for the pneumatic controls. For example, electrical controls or sheathed wire controls which are operated from the cab 23 may be used or may be combined with other types of circuits for controlling the stated functions.

From the foregoing description it is apparent that the coupling and latching mechanism of the present invention includes cab operated controls for selectively coupling the base boom section to the rod and the manual section to the rod latching the manual section to the base section and the manual to the tip section without requiring the operator to leave the cab.

Although the best mode contemplated for carrying out the present invention has been herein shown and described it will be apparent that modification and variation may be made without departing from what is regarded to be the subject matter of the invention.

What is claimed is:

1. In a crane or the like having an operator's cab and a multi-section telescopic boom including a base boom section, a manual boom section, and at least one additional boom section, power means having one part connected to said additional section and an extensible and retractable rod means; the improvement which comprise first coupling means supported on said base section in position to be coupled to said rod means; second coupling means supported on said manual section in position to be coupled to said rod means; said rod means supporting a first and second transversely extending pin; said first coupling means comprising at least one pair of cooperating jaws movable between a position coupled to said first pin and a position uncoupled from said pin; said second coupling means comprising at least one pair of cooperating jaws movable between a position coupled to said second pin and a position uncoupled from said second pin; first jaw locking means movable between a position locking said first jaws in coupled engagement with said first pin and a position uncoupling said first pin from said first jaws; second jaw locking means movable between a position locking said second jaws in coupled engagement with said second pin and a position uncoupling said second pin from said second jaws; first latch means adapted to latch said manual section in a selected one of a plurality of positions to said base section; second latch means adapted to selectively latch said manual section to said additional section; first control means operabler from said cab when in one operative position for controlling said coupling means and said latch means in a manner permitting extension and retraction of said manual section relative to the base section by said power means; and when in a second operative position for controlling said coupling means and said latch means for permitting extension and retraction of said at least one additional boom section relative to said manual section, and second control menas in said cab for extending and retracting said rod means on said power means.

2. In a crane or the like having an operator's cab and a multi-section telescopic boom including a base boom section, a manual boom section, and at least one additional boom section, power means having one part connected to said additional section and an extensible and retractable rod means; the improvement which comprises first coupling means supported on said base section in position to be coupled to said rod means; second coupling means supported on said manual section in position to be coupled to said rod means; first latch means adapted to latch said manual section in a selected one of a plurality of positions to said base section; second latch means adapted to selectively latch said manual section to said additional section; first control means operable from said cab when in one operative position for controlling said coupling means and said latch means in a manner permitting extension and retraction of said manual section relative to said base section by said power means; and when in said second operative position for controlling said coupling means and said latch means for permitting extension and retraction of said at least one additional boom section relative to said manual section, and second control means in said cab for extending and retracting said rod on said power means; said rod including a pair of first and second pins extending transversely of said rod; each of said coupling means comprising at least one pair of cooperating jaws movable between a position coupled to an associated one of said pins and a position uncoupled from said associated pin; said first and second coupling means including first and second locking means movable between a position locking the associated jaws in coupled engagement with the first and second pins respectively, and to uncoupled positions; said cooperating jaws being pivotally supported and each pair of jaws having cooperative surfaces defining a jaw opening notch leading into cooperating recesses for receiving said associated pins in coupled engagement; said jaw opening notches of said first coupling jaws and second coupling jaws facing each other; said first pin moving into coupling position to response to extension of said rod by first moving said first pin against at least one notch forming surface of said first pair of jaws and then moving said first pin into said pin receiving recess of said first jaws thereby closing said first jaws about the first pin; said second pin moving into coupling position with said second pair of jaws in response to retraction of said rod by first moving said second pin against at least one notch forming surface of said second pair of jaws and then moving said second pin into said pin receiving recess thereby closing said second jaws about said second pin; resilient means for independently urging said locking means into said locking position with said associated pairs of jaws when said jaws are in coupled position; and first and second power operated means for independently removing the locking means from locking position with the associated jaws in response to selective actuation of said first control means.

3. An apparatus according to claim 2 wherein both of said coupling means are locked in their coupled positions when said manual section is fully retracted and said first control means is in a neutral position thereby obviating the need of separately latching the manual section to the base section in retracted position.

* * * * *